US006736197B2

(12) United States Patent
Nozaki et al.

(10) Patent No.: US 6,736,197 B2
(45) Date of Patent: May 18, 2004

(54) HEAT EXCHANGER

(75) Inventors: Takahiro Nozaki, Anjo (JP); Yasutoshi Yamanaka, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/102,028

(22) Filed: Mar. 20, 2002

(65) Prior Publication Data

US 2002/0134536 A1 Sep. 26, 2002

(30) Foreign Application Priority Data

Mar. 23, 2001 (JP) ..... 2001-085725

(51) Int. Cl.[7] ..... F28F 9/013
(52) U.S. Cl. ..... 165/149; 29/890.03
(58) Field of Search ..... 165/149, 76; 29/890.03

(56) References Cited

U.S. PATENT DOCUMENTS

| | | | | | |
|---|---|---|---|---|---|
| 3,627,035 | A | * | 12/1971 | Astrup | 165/149 |
| 3,939,908 | A | * | 2/1976 | Chartet | 165/149 |
| 4,382,464 | A | * | 5/1983 | Melnyk | 165/76 |
| 4,534,407 | A | * | 8/1985 | Lardner | 165/149 |
| 4,738,308 | A | * | 4/1988 | Moranne | 165/149 |
| 5,205,354 | A | * | 4/1993 | Lesage | 165/149 |
| 5,944,095 | A | * | 8/1999 | Fukuoka et al. | 165/149 |
| 6,006,430 | A | * | 12/1999 | Fukuoka et al. | 29/890.03 |

FOREIGN PATENT DOCUMENTS

| | | | | | |
|---|---|---|---|---|---|
| DE | 3916788 | A1 | * | 2/1990 | 165/149 |
| DE | 19814827 | A1 | * | 10/1999 | |
| EP | 307803 | A1 | * | 3/1989 | 165/149 |
| FR | 2511138 | | | 2/1983 | |
| FR | 2735855 | | | 12/1996 | |
| GB | 1484510 | | | 11/1974 | |
| GB | 1423854 | | | 2/1976 | |
| GB | 2093313 | | | 11/1982 | |
| JP | 03225197 | A | * | 10/1991 | 165/149 |
| JP | 04270895 | A | * | 9/1992 | 165/149 |
| JP | 05079789 | A | * | 3/1993 | |
| JP | 05157484 | A | * | 6/1993 | 165/149 |
| JP | 06142973 | A | * | 5/1994 | |
| WO | 01/33154 | | | 5/2001 | |

* cited by examiner

*Primary Examiner*—Leonard R Leo
(74) *Attorney, Agent, or Firm*—Harness, Dickey & Pierce, PLC

(57) ABSTRACT

An extension 123 of a core plate 121 is brazed to an insert 130 with the extension 123 being held in a holding portion 131 formed in the insert plate 130, and the width Wi of the extension 123 is made to be substantially the same as the width Wc of the insert 130, whereby the retention of flux at longitudinal end portions of the core plate 121 is made difficult. In addition, as a contact area between the extension 123 and the insert 130 can be made larger, the brazing of the extension 123 and the insert 130 can be ensured while the welding of a tank main body 122 and the core plate 121 can be facilitated.

3 Claims, 8 Drawing Sheets

HEAT EXCHANGER

BACKGROUND OF THE INVENTION

1. Field of the Invention

The present invention relates to a heat exchanger which can effectively be applied to an intercooler for cooling air (intake air) which is induced into an internal combustion engine to support combustion.

2. Description of the Related Art

FIG. 7A is a front view of an intercooler which has been being made, on an experimental basis, for a study by the inventor, et al, and FIG. 7B is an enlarged view of a portion of the intercooler indicated by an arrow B in FIG. 7A. In this experimentally studied intercooler, reinforcement plates (inserts) 130 and core plates 121 are brazed together with longitudinal end portions of the inserts 130 being inserted into holes formed in longitudinal end portions of the core plates 121.

Due to this, there remains a large amount of flux at the end portions of the core plates 121 where the inserts 130 are inserted, and this residual flux deteriorates the weldability between a tank main body 122 and the core plate 121.

On the other hand, as shown in FIG. 8A, a part of the core plate 121 is extended onto the insert 130 so that a portion so extended (an extension 123) is then inserted in the insert 130 for brazing. This can prevent the accumulation of such a large quantity of flux at the portion of the core plate 121 where the tank main body 122 is welded. As shown in FIG. 8B, however, as a contact area between the extension 123 and the insert 130 is small, it is difficult to secure a required brazing reliability.

SUMMARY OF THE INVENTION

The present invention was made in view of these problems, and an object thereof is to improve the weldability between the core plate and the tank main body and to ensure that the core plate (the extension) and the insert (the reinforcement plate) are brazed together properly.

With a view to attaining the object, according to an aspect of the invention, there is provided a heat exchanger comprising a plurality of tubes (111) through which fluid flows, fins (112) joined to external surfaces of the plurality of tubes (111) for promoting heat exchange between fluid flowing between the plurality of tubes (111) and fluid flowing through the interior of the plurality of tubes (111), reinforcement plates (130) disposed at end portions of a core portion (110) constituted by the plurality of tubes (111) and the fins (112) in such a manner as to extend substantially in parallel to the plurality of tubes (111) so as to reinforce the core portion (110), and header tanks (120) disposed at longitudinal end portions of the plurality of tubes (111) in such a manner as to extend in a direction normal to the longitudinal direction of the plurality of tubes (111) and adapted to communicate with the plurality of tubes (111), wherein the header tank (120) is constituted by a core plate (121) to which the plurality of tubes (111) are joined and a tank main body (122) welded to the core plate (121) so as to constitute a space in the interior of the header tank (120), wherein extensions (123) are provided at longitudinal end portions of the core plate (121) which each have a width (Wc) which is substantially the same as the width (Wi) of the reinforcement plate (130) and extend onto longitudinal end portions of the reinforcement plates (130), respectively, so as to be brazed thereto, and wherein holding portions (131) are further provided at the longitudinal end portions of the reinforcement plates (130) so as to hold therein the extensions (123), respectively.

Thus, according to this aspect of the invention, as the extension (123) of the core plate (120) is brazed to the reinforcement plate (130) with the extension (123) being held in the holding portion (131) formed on the reinforcement plate (130), different from the case with the experimentally studied intercooler described above, flux hardly remains at the longitudinal end portions of the core plates (121). Consequently, the tank main body (122) can easily be welded to the core plate (121).

In addition, as the extension (123) has the width (Wc) which is substantially the same as the width (Wi) of the reinforcement plate (the insert) (130), the contact area between the extension (123) and the reinforcement plate (130) can be made larger than the contact area of the experimentally studied intercooler, whereby it is possible to ensure that the extension (123) and the reinforcement plate (130) are brazed together properly.

As has been described heretofore, according to this aspect of the invention, as the welding of the core plate (121) to the tank main body (122) can be improved and the brazing of the core plate (121) (the extension (123)) to the reinforcement plate (130) can be ensured, the reliability (durability) of the heat exchanger can be increased.

In addition, the holding portion (131) is desirably formed by deviating a portion of the reinforcement plate (130) which is defined by adjacent cut portions (132) in a thickness direction of the reinforcement plate (130).

According to another aspect of the invention, the extension (123) is formed integrally with the core plate (121) in such a manner that the surface of the extension (123) continuously smoothly connects to the surface of the core plate (121).

According to this aspect of the invention, as the tank main body (122) can deviate in the longitudinal direction, a dispersion of production quality (in dimensions) of the core plates (121) and the main tanks (122) can be absorbed. Hence, the generation of a gap attributed to the dispersion of production quality (in dimensions) can be suppressed which will be described herein, later, with reference to FIG. 5B.

The present invention may be more fully understood from the description of a preferred embodiment of the invention, as set forth below, together with accompanying drawings.

DESCRIPTION OF THE PREFERRED EMBODIMENT

Figure 1:
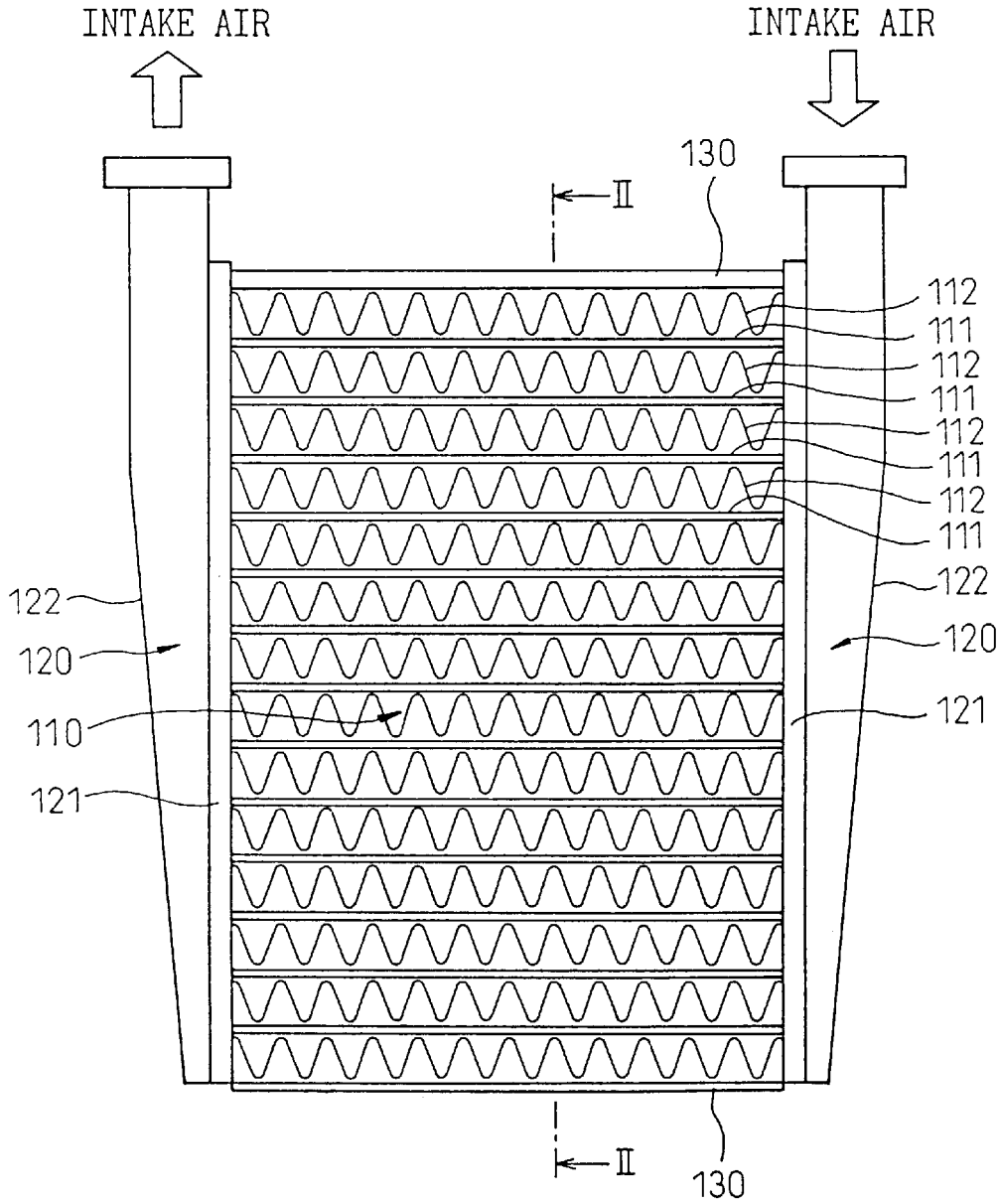
FIG. 1 is a front view of an intercooler according to an embodiment of the present invention.

In an embodiment of the present invention, a heat exchanger according to the present invention is applied to an air-to-air intercooler, and FIG. 1 is a front view (as viewed from a direction in which air flows) of an intercooler 100 according to the embodiment of the present invention.

In FIG. 1, reference numeral 111 denotes flat tubes made of aluminum through which intake air is allowed to flow, and reference numeral 112 denotes outer fins formed into a wavy shape which are joined to the flat surfaces of the tubes 111 for promoting heat exchange between cooling air which passes around the tubes 111 and the intake air. Then, a rectangular cooling core portion (hereinafter, referred to as simply a core) 110 for cooling the intake air is constituted by the outer fins 112 and the tubes 111.

Figure 2:
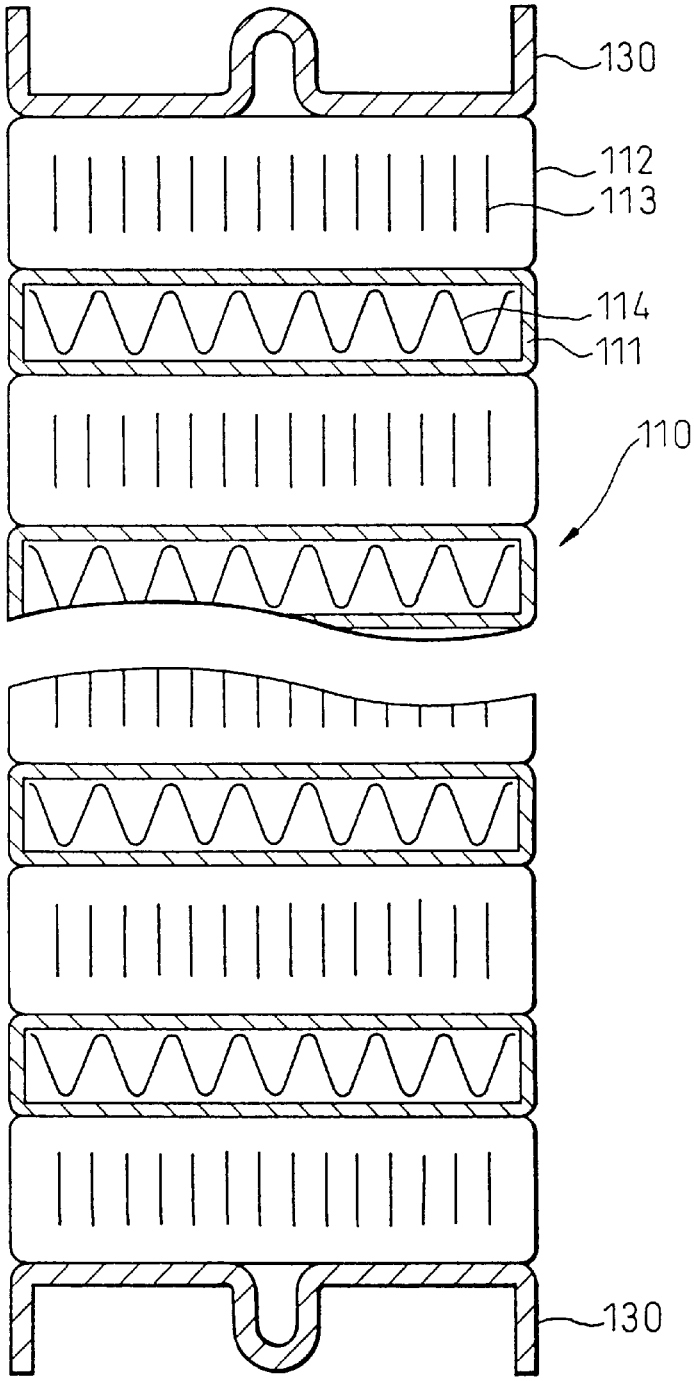
FIG. 2 is a sectional view taken along the line II—II in FIG. 1.

In addition, louvers are provided in the outer fins 112, as shown in FIG. 2, by cutting and raising portions of the outer fins 112 in a shutter-like fashion in order to prevent the development of a temperature boundary layer by disturbing the flow of air. On the other hand, inner fins 114 having a similar construction to that of the outer fins 112 are disposed within the tubes 111.

Incidentally, the tube 111 is fabricated of a sheet material which is clad with a brazing material (in this embodiment, such as specified under JIS (Japanese Industry Standard) A4045 or A4343) on front and back sides thereof by bending and electric welding the sheet material, and the outer fin 112 and the inner fin 114 are brazed to the tube 111 with the brazing material so clad on the tube 111.

In addition, as shown in FIG. 1, header tanks 120 are provided at longitudinal ends of the tubes 111 which header tanks extend in a direction normal to the longitudinal direction of the tubes and are adapted to communicate with the tubes 111, and the header tanks 120 each comprise a core plate 121 made of aluminum to which the tubes are brazed and a tank main body 122 made of aluminum which is welded to the core plate 121 so as to form an interior space within the header tank 120.

Incidentally, the tube 111 is brazed to the core plate 121 with a brazing material clad to front and back sides of the core plate 121. In addition, a right-hand side header tank 120 in FIG. 1 is for distribution and supply of the intake air to the respective tubes 111 whereas a left-hand side header tank 120 in FIG. 1 is for collecting the intake air flowing out of the tubes 111.

In addition, provided on end portions of the core 110, where the header tanks 120 are not provided, are inserts (reinforcement plates) 130 made of aluminum which extend substantially in parallel with the tubes 111 so as to reinforce the core portion 10. The insert 130 is brazed to the outer fin 112 on a core portion 110 side and to the header tanks 120 (the core plates 121) at longitudinal end portions thereof.

Note that a brazing material is clad on the insert 130 at least on the side thereof which faces the outer fin 112 and, in this embodiment, the insert 130 and the outer fin 112 are brazed together with the brazing material clad on the insert 130, and the insert 130 and the core plate 121 are brazed together with a brazing material clad on the core plate 121.

Figure 3:
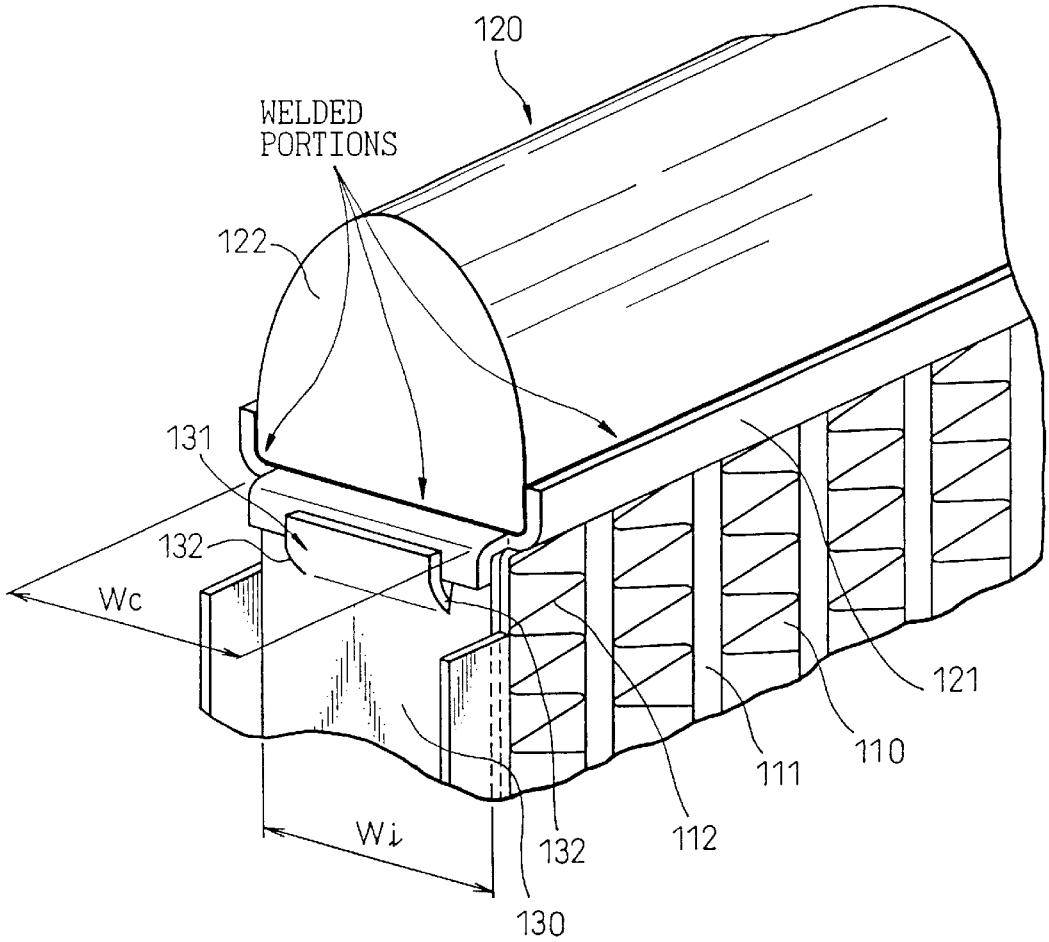
FIG. 3 is an enlarged perspective view of a header tank portion according to the embodiment of the present invention.

Incidentally, as shown in FIG. 3, an extension 123 having a width Wc which is substantially the same as the width Wi of the insert 130 is provided at a longitudinal end portion of the insert 130 in such a manner as to extend to be bent onto the insert 130 for brazing thereat, and this extension 123 is formed integrally with the core plate 121 such that the surface of the extension 123 smoothly continuously connects to the surface of the core plate 121. Note that the widths Wi, Wc are understood to be a dimension measured in a direction normal to the longitudinal direction.

Figure 4A:
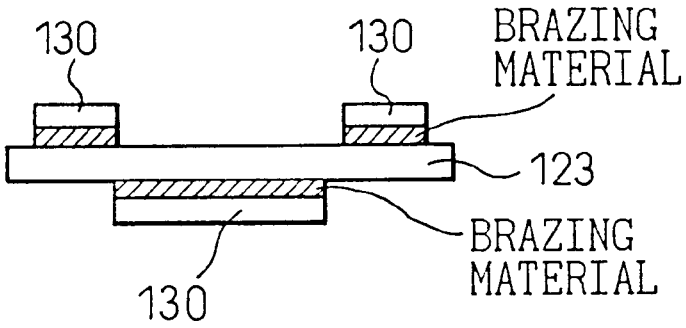
FIG. 4A is a sectional view of a holding portion as viewed from above in FIG. 3 in a state in which an extension is held by the holding portion.
Figure 4B:
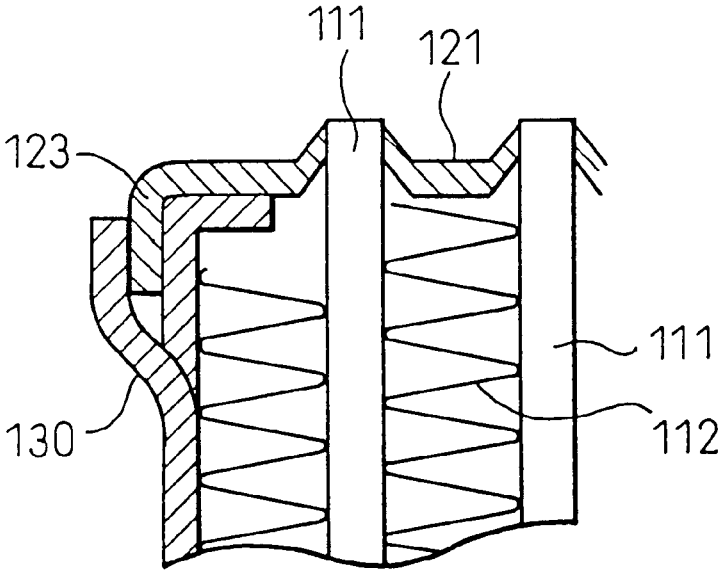
FIG. 4B is a sectional view of the holding portion as viewed from a direction in which air flows, FIGS. 5A and 5B explanatory views for explaining problems with a conventional heat exchanger.

In addition, a holding portion 131 is provided at the longitudinal end portion of the insert 130 for holding therein the extension 123, and the holding portion 131 is constructed by providing a plurality of (two in this embodiment) of slits (cut portions) 132 which extend in the longitudinal direction of the insert 130 from the longitudinal end portion thereof and are deviate a portion of the insert 130 which is defined by the adjacent slits 132 in a thickness direction of the insert 130. Incidentally, FIG. 4A is a sectional view of the holding portion 131 as viewed from above in FIG. 3 in a state in which the extension 123 is held in the holding portion 131, and FIG. 4B is a sectional view of the holding portion 131 as viewed in a direction in which air flows.

Next, a method for making the intercooler 100 will briefly be described.

The tubes 111, fins 112 and inserts 130 are placed horizontally on a working table such as a surface plate, and then, as shown in FIG. 1, they are assembled together in a laminating fashion to fabricate the core 110 (a core fabricating process).

Next, after the core plates 121 are assembled to the core 110 (including the inserts 130)(a tank assembling process), the core plates 121 and the core 110 are heated to be brazed together in an oven in such a manner that the width direction of the insert 130 coincides with a perpendicular direction while the assembled condition is being retained with a fixture such as a wire (a brazing process).

Then, tank main bodies 122 are welded to the core plates 121, respectively after the completion of the brazing process, and thereafter required inspections such as leakage (brazing failure, welding failure) inspections and dimensional inspections are carried out to complete the production of the intercooler.

Next, the features (function and effectiveness) of the present invention will be described.

In this embodiment, as the extension 123 of the core plate 121 is brazed to the insert 130 with the extension 123 being held in the holding portion 131 formed in the insert 130, different from the case with the experimentally studied intercooler described above, flux hardly remains at the longitudinal end portions of the core plates 121. Consequently, the tank main body 122 can easily be welded to the core plate 121.

In addition, as the extension 123 has a width Wc which is substantially the same as the width Wi of the insert 130, the contact area between the extension 123 and the insert 130 can be made larger than that of the aforesaid experimentally studied intercooler, thereby making it possible to ensure that the extension 23 and the insert 130 can be brazed together properly.

As has been described heretofore, according to the embodiment, as the welding of the core plates 121 and the tank main bodies 122 can be improved and the brazing of the core plates 121 (the extensions 123) and the inserts 130 can be ensured, the reliability (durability) of the intercooler 100 can be increased.

Figure 5A:
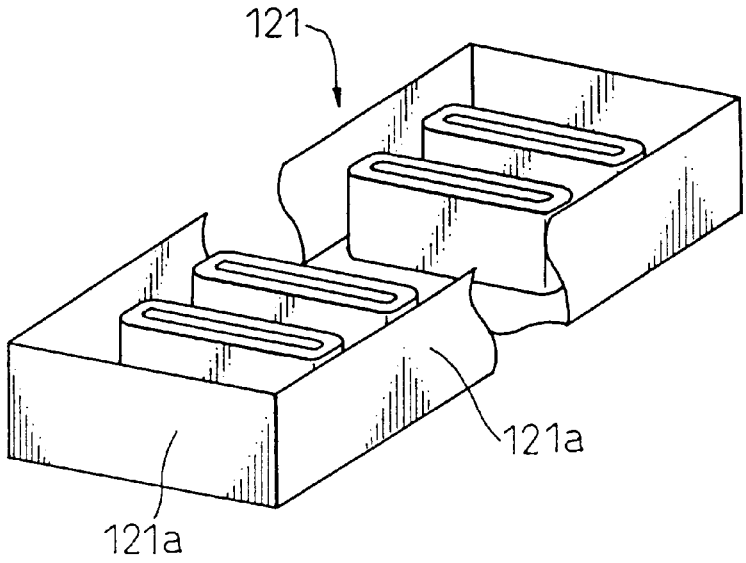
Figure 5B:
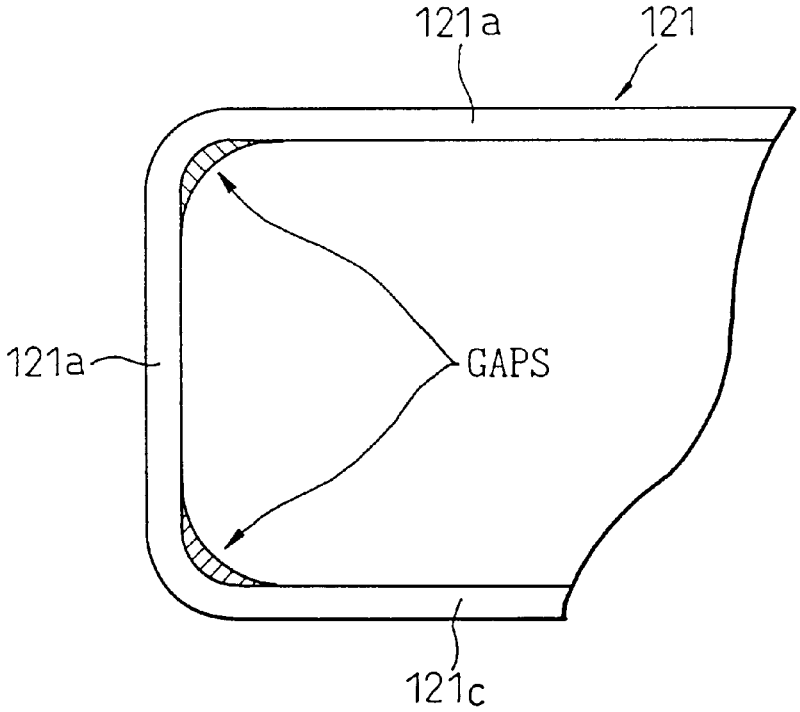

Incidentally, as shown in FIG. 5A, in the event that the full circumferential edge area of the core plate 121 is erected so as to form a wall portion 121*a* and that the tank main body 122 and the core plate 121 are welded together in a state in which the tank main body 122 is compactly fitted in the core plate 121 in such a manner that the tank main body 122 is brought into contact with an interior wall of the wall portion 121*a*, gaps are easily generated at corner portions, as shown in FIG. 5B, due to a dispersion of production (dimensions) of the core plates 121 and the tank main bodies 122.

Figure 6:
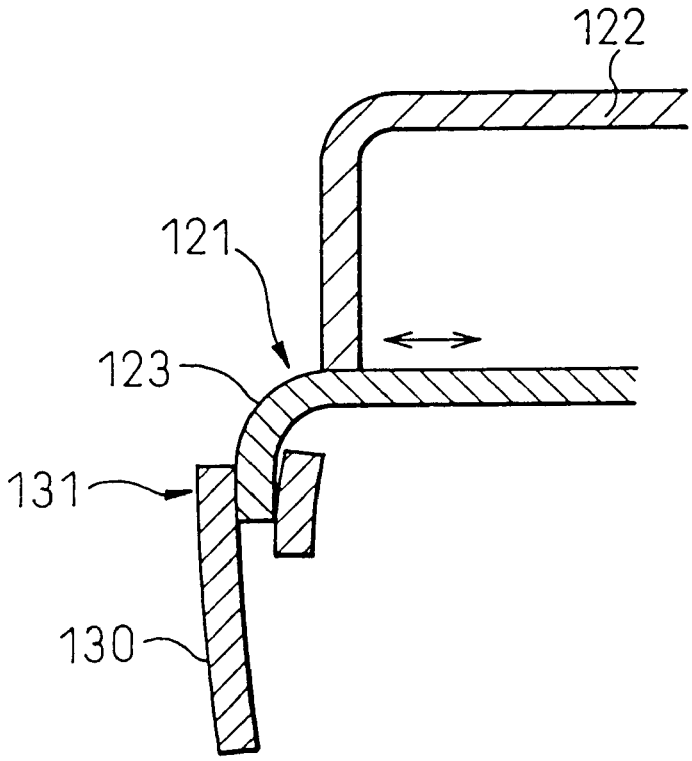
FIG. 6 is a sectional view for explaining the effectiveness of an intercooler according to the embodiment of the present invention.
Figure 7A:
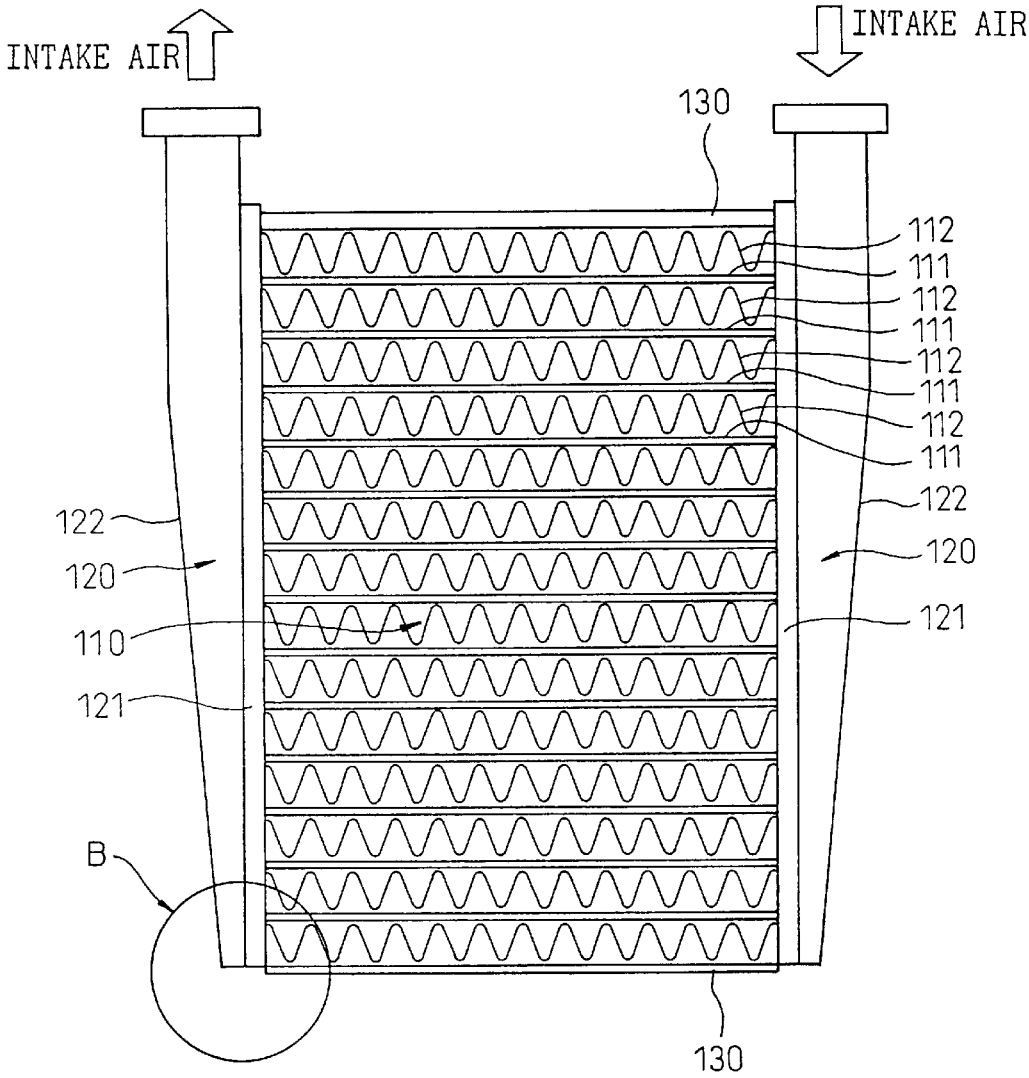
FIG. 7A is a front view of an intercooler which is being made on an experimental basis for study.
Figure 7B:
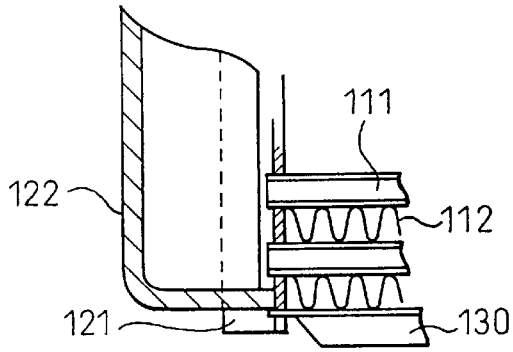
FIG. 7B is an enlarged sectional view of a portion indicated by an arrow B in FIG. 7A, and FIGS. 8A and 8B are explanatory views for explaining a problem with a conventional heat exchanger.
Figure 8A:
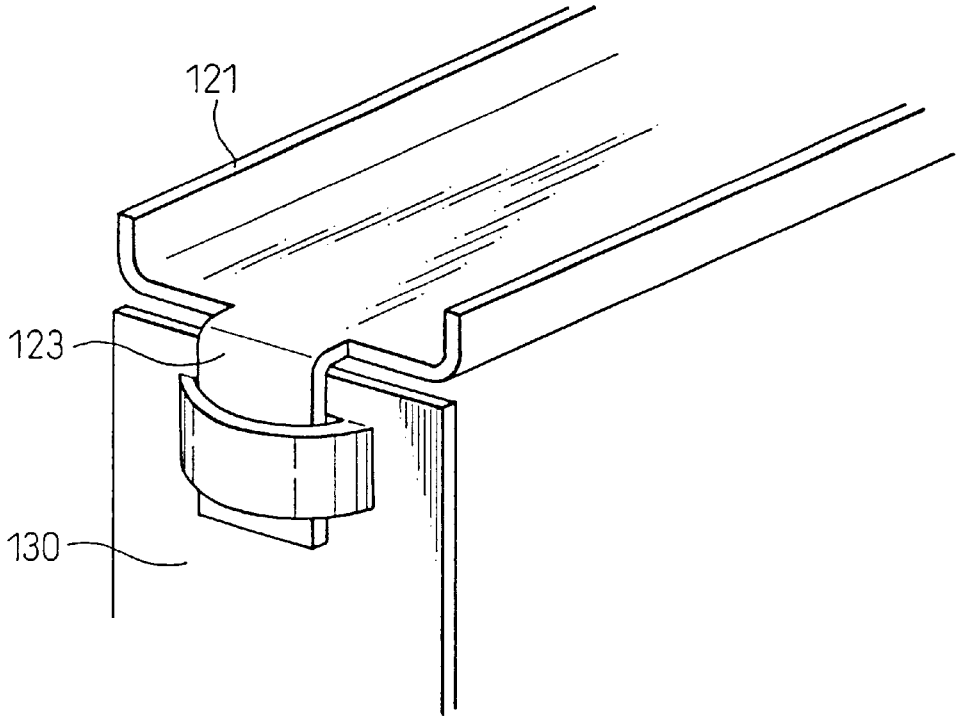
Figure 8B:
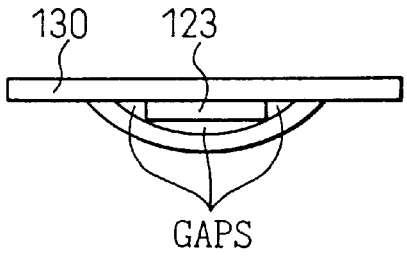

In contrast to this, according to the embodiment of the present invention, as the extension 123 is formed integrally with the core plate 121 in such a manner that the surface of the extension 123 smoothly continuously connects to the surface of the core plate 121, as shown in FIG. 6, a construction can be provided in which there is provided no wall portion 121*a* at the longitudinal end portions of the core plate 121 and, therefore, the positions of the longitudinal end portions of the tank main body 122 are not restrained (restricted) by the core plate 121. Consequently, as the tank main body 122 can deviate in the longitudinal directions, the dispersion of production (dimensions) of the core plates 121 and the tank main bodies 122 can be absorbed, whereby the generation of gaps at the corner portions can be prevented.

In the aforesaid embodiment, while the present invention is applied to the intercooler, the present invention is not limited to such an application but may be applied to other types of heat exchangers (such as a condenser and a radiator).

While the invention has been described by reference to the specific embodiment chosen for the purpose of illustration, it should be apparent that numerous modifications could be made thereto by those skilled in the art without departing from the basic concept and scope of the invention.

What is claimed is:

1. A heat exchanger comprising a plurality of tubes through which fluid flows, fins joined to external surfaces of said plurality of tubes for promoting heat exchange between fluid flowing around said plurality of tubes and fluid flowing through the interior of said plurality of tubes, reinforcement plates disposed at end portions of a core portion comprised of said plurality of tubes and said fins in such a manner as to extend substantially in parallel to said plurality of tubes so as to reinforce said core portion, and header tanks disposed at longitudinal end portions of said plurality of tubes in such a manner as to extend in a direction normal to the longitudinal direction of said plurality of tubes and adapted to communicate with said plurality of tubes, wherein each of said header tanks comprises a core plate to which said plurality of tubes are joined and a tank main body welded to said core plate so as to constitute a space in the interior of said header tank, wherein extensions are provided at longitudinal end portions of said core plate which each have a width (Wc) which is substantially the same as the width (Wi) of a respective reinforcement plate and extend onto longitudinal end portions of said respective reinforcement plate, a brazing material is clad on the core plate and said respective reinforcement plate to braze the longitudinal end portion of the respective reinforcement plate and the extension of the core plate, wherein holding portions are further provided at said longitudinal end portions of said reinforcement plates so as to hold therein said extensions, respectively;

wherein a plurality of cut portions are provided in said reinforcement plate in such a manner as to extend in the longitudinal direction of said reinforcement plate from the longitudinal end portion thereof, and wherein said holding portion is formed by deviating a portion of said reinforcement plate which is defined by said adjacent cut portions in a thickness direction of said reinforcement plate.

2. A heat exchanger as set forth in claim 1, wherein said extension is formed integrally with said core plate in such a manner that the surface of said extension smoothly and continuously connects to the surface of said core plate.

3. A heat exchanger as set forth in claim 1, wherein wall portions provided at longitudinal sides of the core plate are bent toward the header tank and the extensions provided at longitudinal ends of the core plate extend in a direction away from the header tank.

* * * * *